US008662061B1

(12) United States Patent
Darlington et al.

(10) Patent No.: US 8,662,061 B1
(45) Date of Patent: Mar. 4, 2014

(54) CROSSBOW WITH IMPROVED BOLT RETAINING SPRING

(76) Inventors: Rex F. Darlington, Whittemore, MI (US); David McNeil, II, Howard City, MI (US)

( * ) Notice: Subject to any disclaimer, the term of this patent is extended or adjusted under 35 U.S.C. 154(b) by 211 days.

(21) Appl. No.: 13/359,558

(22) Filed: Jan. 27, 2012

(51) Int. Cl.
*F41B 5/12* (2006.01)

(52) U.S. Cl.
CPC ..... *F41B 5/12* (2013.01)
USPC ..... 124/25; 124/41.1; 124/44.5

(58) Field of Classification Search
CPC ..... F41B 5/12
USPC ..... 124/25, 41.1, 44.5
See application file for complete search history.

(56) References Cited

U.S. PATENT DOCUMENTS

| | | | | |
|---|---|---|---|---|
| 3,788,299 | A * | 1/1974 | Mathews | 124/35.1 |
| 4,030,473 | A * | 6/1977 | Puryear | 124/35.1 |
| 4,722,318 | A * | 2/1988 | Yankey | 124/25 |
| 5,119,797 | A * | 6/1992 | Anderson | 124/25 |
| 5,598,829 | A * | 2/1997 | Bednar | 124/25 |
| 5,649,520 | A * | 7/1997 | Bednar | 124/25 |
| 5,884,614 | A * | 3/1999 | Darlington et al. | 124/25 |
| 6,736,123 | B1 * | 5/2004 | Summers et al. | 124/25 |
| 6,802,304 | B1 * | 10/2004 | Chang | 124/25 |
| 7,017,568 | B1 * | 3/2006 | Smith | 124/25 |
| 7,455,059 | B2 * | 11/2008 | Shaffer | 124/25 |
| 7,588,022 | B2 * | 9/2009 | Chang | 124/25 |
| 7,624,724 | B2 * | 12/2009 | Bednar et al. | 124/25 |
| 7,770,567 | B1 * | 8/2010 | Yehle | 124/25 |
| 7,832,386 | B2 * | 11/2010 | Bednar et al. | 124/25 |
| 7,938,108 | B2 * | 5/2011 | Popov et al. | 124/25 |
| 8,033,275 | B2 * | 10/2011 | Bednar et al. | 124/25 |
| 8,061,339 | B2 * | 11/2011 | Shaffer | 124/25 |
| 8,191,541 | B2 * | 6/2012 | Shaffer et al. | 124/25 |
| 8,522,761 | B1 * | 9/2013 | Chu | 124/25 |
| 2008/0060629 | A1 * | 3/2008 | Chang | 124/25 |
| 2008/0127956 | A1 * | 6/2008 | Bednar et al. | 124/25 |
| 2009/0178657 | A1 * | 7/2009 | Shaffer | 124/25 |
| 2009/0194086 | A1 * | 8/2009 | Kempf | 124/25 |
| 2013/0098343 | A1 * | 4/2013 | Grace | 124/25 |

* cited by examiner

*Primary Examiner* — Gene Kim
*Assistant Examiner* — Alexander Niconovich
(74) *Attorney, Agent, or Firm* — Reising Ethington PC

(57) ABSTRACT

A crossbow includes a handle or barrel having a bolt support surface, a forward end with at least one flexible limb, and a rearward end. A support on the barrel overlies at least a portion of the bolt support surface. A bolt retaining spring on the support extends toward the bolt support surface for holding a bolt on the support surface. The retaining spring extends from the support at a downward and rearward angle toward the bolt support surface and then at an upward and rearward angle to a free end between the bolt support surface and the support. The spring preferably is of one-piece construction having a first portion underlying and secured to the support, a second portion extending downwardly and rearwardly from a forward end of the first portion, and a third portion extending upwardly and rearwardly from the second portion and the bolt support surface.

13 Claims, 6 Drawing Sheets

CROSSBOW WITH IMPROVED BOLT RETAINING SPRING

The present disclosure is directed to a crossbow having a bolt retaining spring configured to resist damage during cocking of the bow.

BACKGROUND AND SUMMARY OF THE DISCLOSURE

It is desirable to use a retaining spring to hold the arrow or bolt in place on the crossbow handle or barrel when the bolt is placed on the bowstring and ready to fire. The purpose of the retaining spring is to keep the bolt from sliding away from the bowstring and/or from falling off of the crossbow barrel. Bolt-retaining springs of current design are subject to damage when a cocking aid is used to cock the crossbow. If the bowstring is attached incorrectly to the cocking aid, or if the angle of tension used to pull the cocking aid is incorrect, the bowstring will travel over rather then under the current retaining spring resulting in damage to the spring. A general object of the present disclosure is to provide a crossbow with a retaining spring configured to resist damage during cocking.

The present disclosure embodies a number of aspects that can be implemented separately from or in combination with each other.

A crossbow in accordance with one aspect of the present disclosure includes a barrel having a bolt support surface, a forward end with at least one flexible limb, and a rearward end. A support on the barrel overlies at least a portion of the bolt support surface. A bolt retaining spring on the support extends toward the bolt support surface for holding a bolt on the support surface. The retaining spring extends from the support at a downward and rearward angle toward the bolt support surface and then at an upward and rearward angle to a free end between the bolt support surface and the support. The spring preferably is of one-piece construction having a first portion underlying and secured to the support, a second portion extending downwardly and rearwardly from a forward end of the first portion, and a third portion extending upwardly and rearwardly from the second portion and the bolt support surface. In one exemplary embodiment, the second and third portions are straight and joined to each other at an angle. In a second exemplary embodiment, the second and third portions are curved and joined to each other in an arc.

BRIEF DESCRIPTION OF THE DRAWINGS

The disclosure, together with additional objects, features, advantages and aspects thereof, will best be understood from the following description, the appended claims and the accompanying drawings, in which:

DETAILED DESCRIPTION OF PREFERRED EMBODIMENTS

Figure 1:
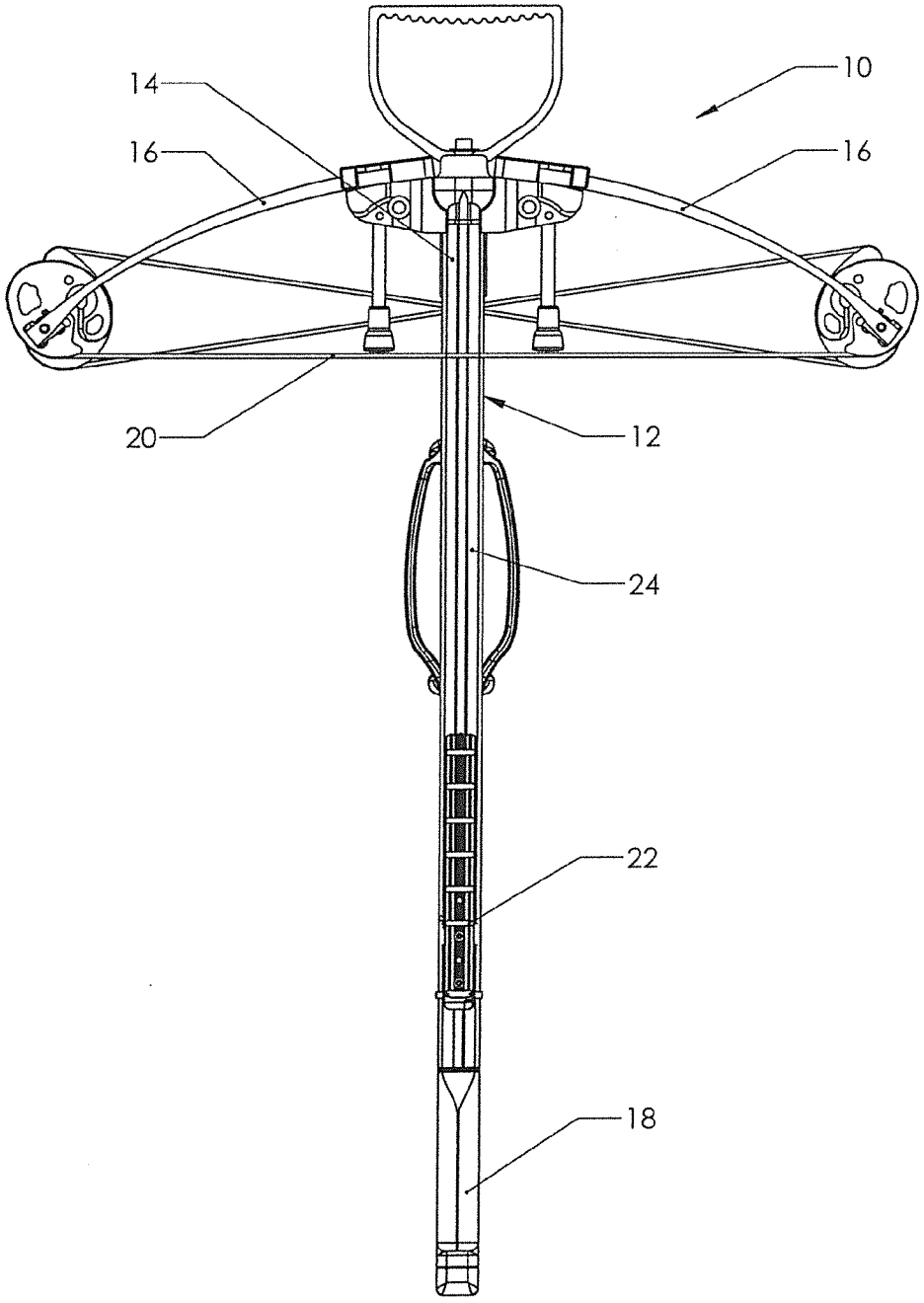
FIG. 1 is a top plan view of a crossbow in accordance with an exemplary embodiment of the present disclosure.
Figure 2:
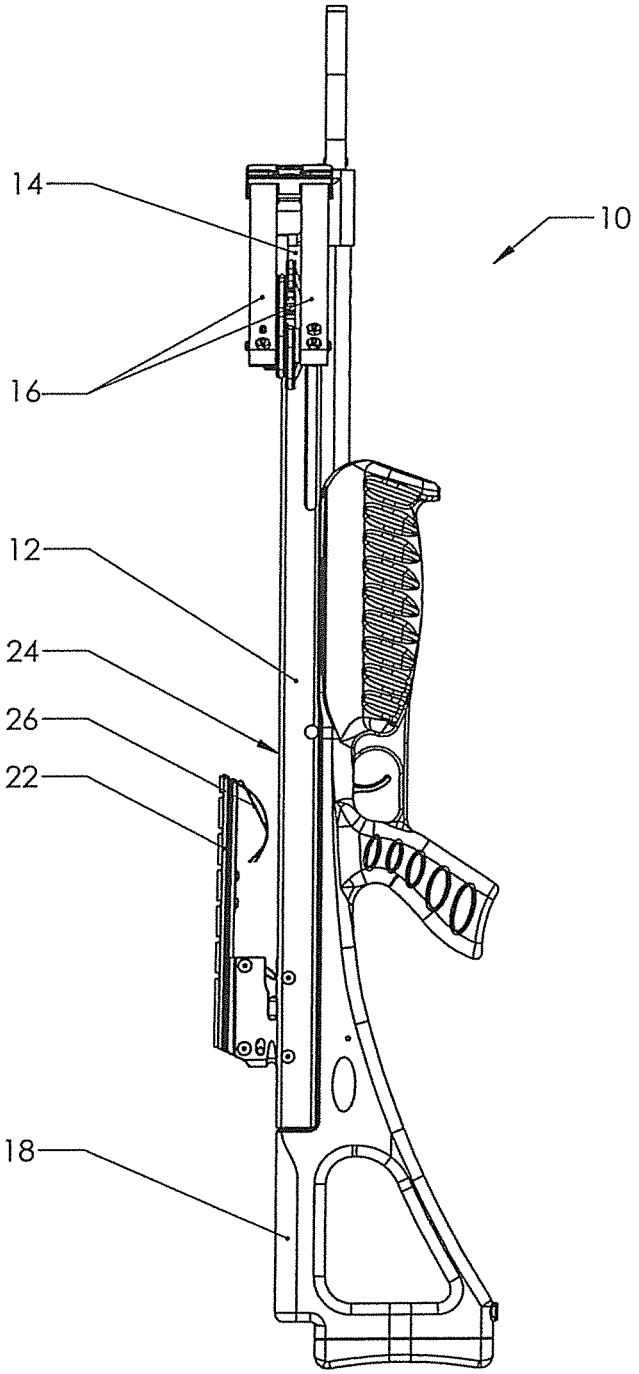
FIG. 2 is a side elevational view of the crossbow illustrated in FIG. 1.

FIGS. 1 and 2 illustrate a crossbow 10 in accordance with an exemplary embodiment of the present disclosure as including a handle or barrel 12 having a forward end 14 to which at least one flexible resilient limb 16 is secured, and a rearward end 18. In the exemplary embodiment of FIG. 1, a pair of flexible resilient limbs 16 are secured to the forward end of barrel 12, and a bowstring 20 extends between the free ends of limbs 16. A support 22 is mounted on barrel 12 overlying a portion of the bolt support surface 24 on the barrel. It will be recognized that the bow 10 illustrated in FIG. 1 is rudimentary and schematic for purposes of illustration only. Limbs 16 can be of any suitable material and/or geometry. The bow can be a compound bow having pulleys at the ends of the limbs for affecting the force/draw characteristics of the bow. By way of example only, compound crossbows are illustrated in FIGS. 20, 20A and 20B of U.S. Pat. No. 6,990,970 and in FIG. 7 of U.S. Pat. No. 7,997,259. Other limb configurations, such as recurve limb configurations, can be employed.

Figure 3:
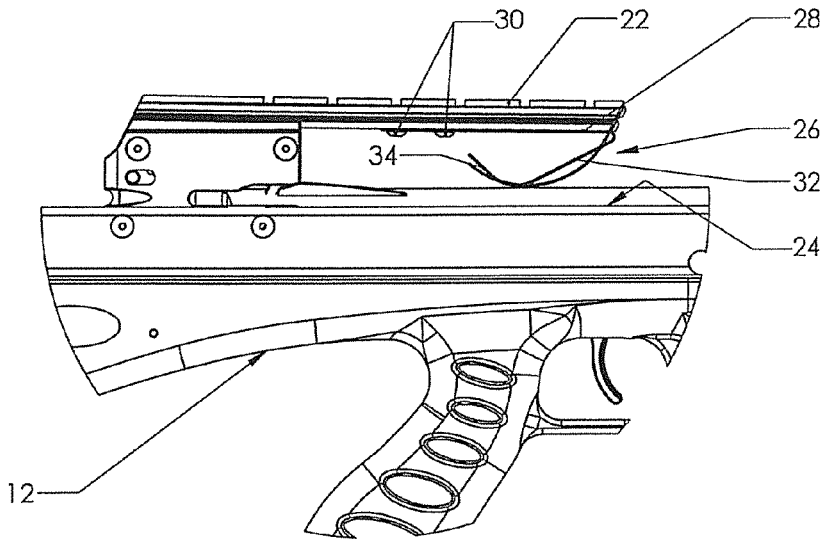
FIG. 3 is a fragmentary elevational view of a portion of the crossbow illustrated in FIG. 1.
Figure 4:
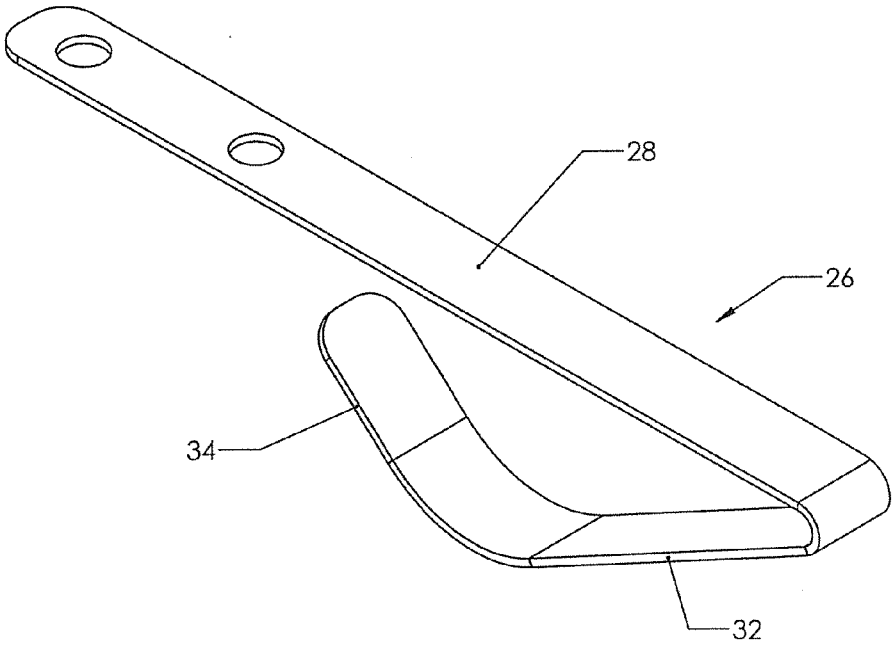
FIG. 4 is a perspective view of the bolt retaining spring in the crossbow of FIGS. 1-3.
Figure 5:
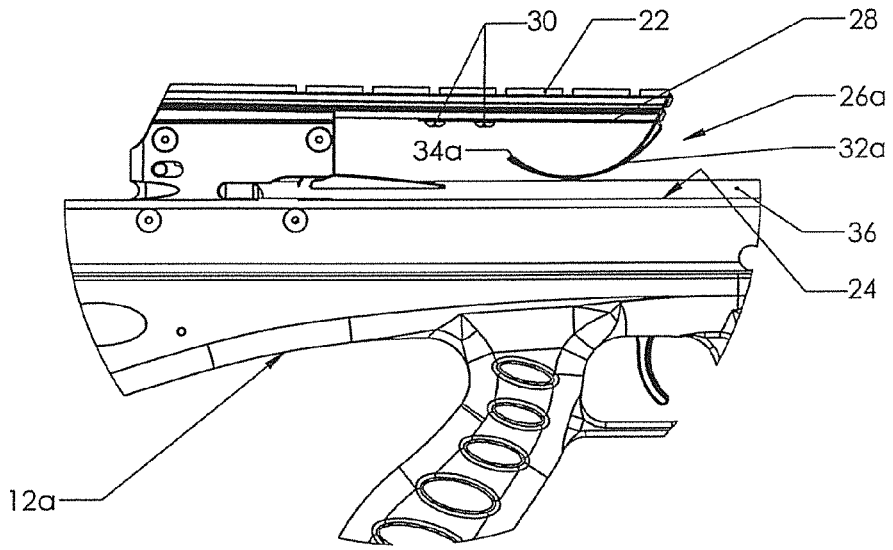
FIG. 5 is a view similar to that of FIG. 3 but showing a second exemplary embodiment of the crossbow.
Figure 6:
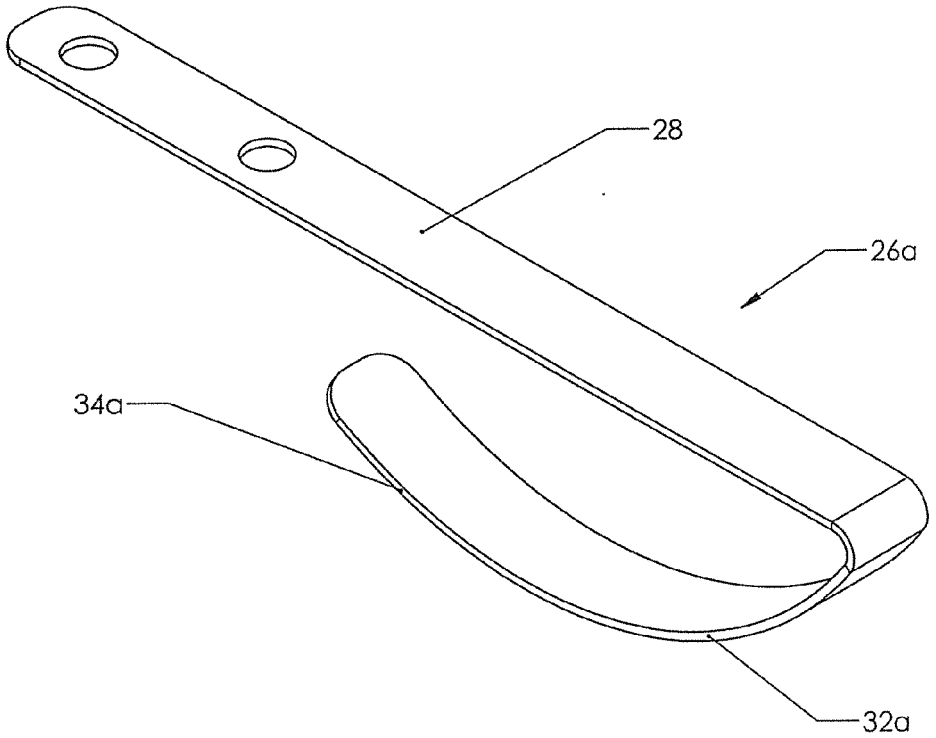
FIG. 6 is a perspective view of the bolt retaining spring in the crossbow of FIG. 6.

As shown in FIGS. 2 and 3, support 22 is attached to barrel 12 so as to be spaced from bolt support surface 24 and to overlie at least a portion of the bolt support surface. Support 22 can be a scope mount support, for example, or can be provided solely for mounting of a bolt retaining spring 26. Bolt retaining spring 26 preferably is of one-piece construction and includes a first portion 28 mounted to the underside of support 22 such as by screws 30. A second spring portion 32 extends downwardly and rearwardly (with respect to barrel 12) from the forward edge of first portion 28 toward bolt support surface 24, and a third portion 34 extends upwardly and rearwardly (with respect to barrel 12) from the lower and rearward edge of second portion 32. Portions 32 and 34 preferably are flat. Portion 28 is contoured according to the undersurface of support 22, which can be flat. Spring 26 can be of spring metal construction, for example, and formed in a progressive bending operation. The juncture of portions 32, 34 preferable is spaced from support surface 24 in the absence of a bolt 36, as best seen in FIG. 2. Portions 32 can be at an angle of about thirty degrees to portion 28, for example, and portion 34 can be at angle of one hundred ten degrees to portion 32, for example.

Bolt retaining spring 26 holds a bolt or arrow 36 against bolt support surface 24 after cocking of the bow. As the bow is cocked, bowstring 20 (FIG. 1) is drawn beneath spring 26, and is secured in position until released by a trigger 40 or other suitable string-release mechanism. During such cocking action, as bowstring 30 is drawn beneath spring 26, the bowstring first engages spring portion 32 and flexes such spring portion upwardly toward first portion 28. As the bowstring passes beneath spring 26, the spring returns to the position illustrated in FIG. 2 to hold bolt 36 in position after cocking the bow.

Figure 7:
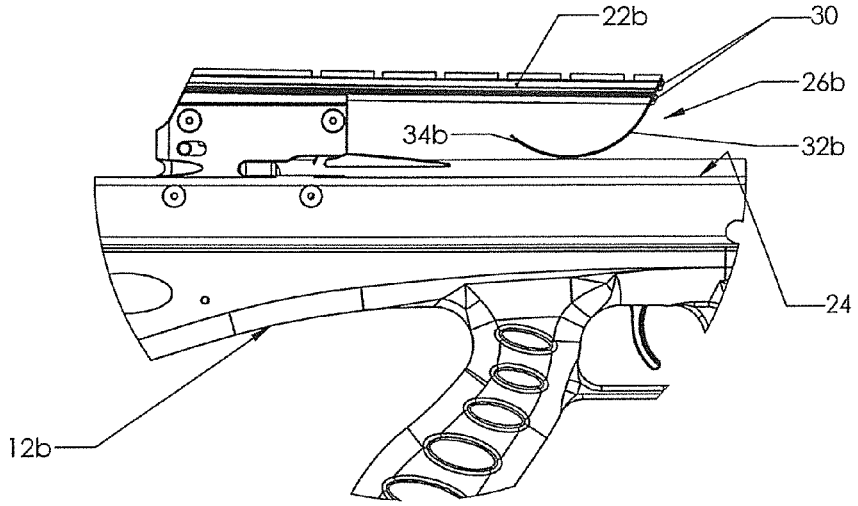
FIG. 7 is a view similar to that of FIG. 3 but showing a third exemplary embodiment of the crossbow.
Figure 8:
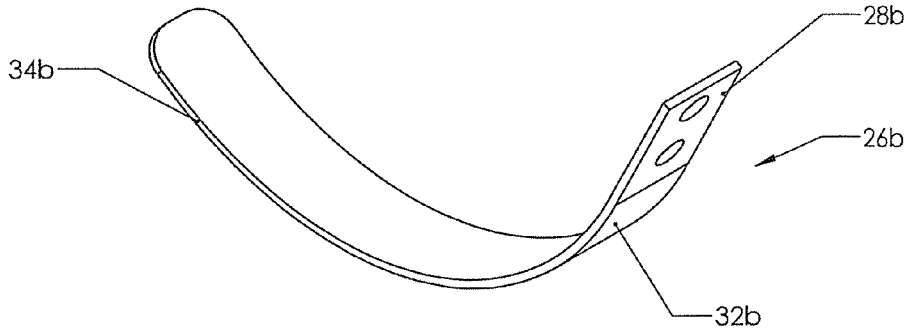
FIG. 8 is a perspective view of the bolt retaining spring in the crossbow of FIG. 7.

FIGS. 5-8 illustrate a second and third exemplary embodiment of the bolt retaining spring. Reference numerals in FIGS. 5-8 that are the same as those in FIGS. 1-4 indicate identical components, and reference numerals with a letter suffix indicate related but modified components. The bolt retaining spring 26*a* in FIGS. 5-6 has second and third portions 32*a*, 34*a* that are arcuate and joined to each other in a continuous arc, preferably at constant radius. The bolt retaining spring 26*b* in FIGS. 7-8 is similar to the spring 26*a* of FIGS. 5-6 except that the attachment portion 26*b* extends from portion 32*b* for attachment by screws 30 to the end rather than the underside of support 22*b*.

Figure 9:
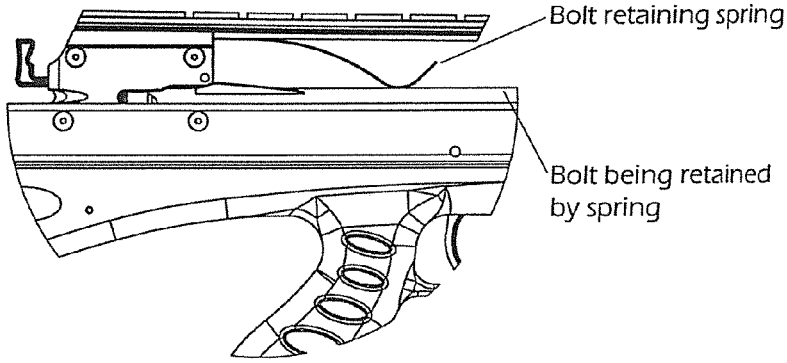
FIGURE 9 (PRIOR ART)
FIG. 9 is a fragmentary elevational view similar to that of FIG. 2 but illustrating a bolt retaining spring of current design.
Figure 10:
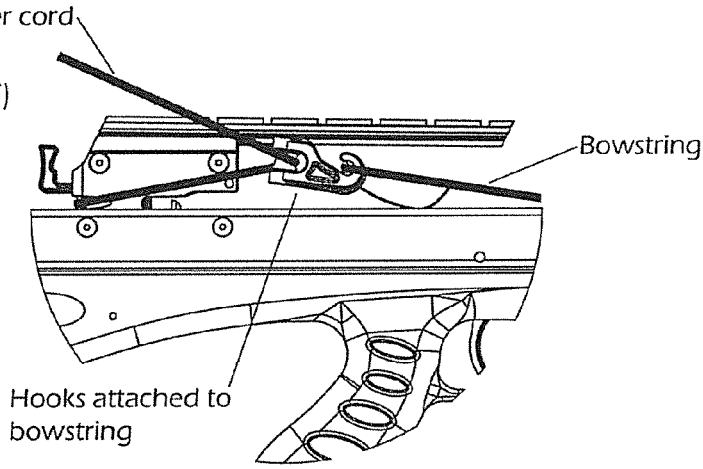
FIGURE 10 (PRIOR ART)
FIG. 10 is a fragmentary elevational view that illustrates a problem that can occur employing the bolt retaining spring of FIG. 9.
Figure 11:
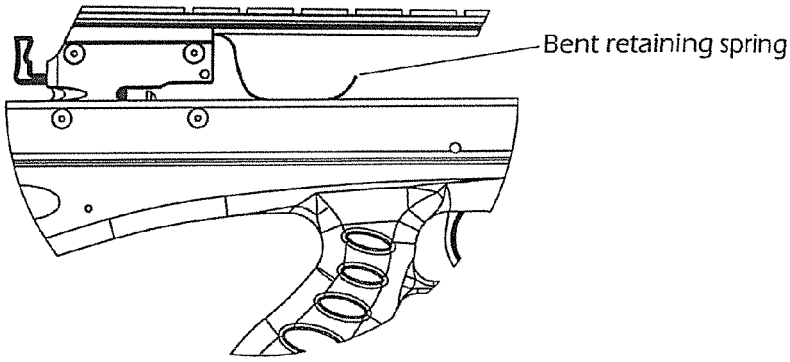
FIGURE 11 (PRIOR ART)
FIG. 11 is a fragmentary elevational view similar to those of FIGS. 9-10 illustrating damage to the bolt retaining spring of FIG. 9 resulting from the mis-cocking situation of FIG. 10.

FIGS. 9-11 illustrate a bolt retaining spring of current design and what can occur if the bow is improperly cocked. With the free end of the bolt retaining spring extending forwardly, the bowstring can be drawn to a position overlying the spring during cocking, bending and damaging the spring so that the spring assumes a geometry like that in FIG. 11, which can exacerbate the situation during the next cocking operation.

There thus has been disclosed a crossbow with improved bolt retaining spring that addresses the objects and aims previously set forth. The disclosure has been presented in conjunction with an exemplary embodiment, and modifications and variations have been discussed. Other modifications and variations readily will suggest themselves to persons of ordinary skill in the art in view of the foregoing description. The disclosure is intended to embrace these and all other modifications and variations as fall within the spirit and broad scope of the appended claims.

The invention claimed is:

1. A crossbow that includes:

a barrel having a bolt support surface, a forward end with at least one flexible limb, and a rearward end, a support on said barrel overlying at least a portion of said bolt support surface, and a bolt retaining spring on said support and extending toward said bolt support surface for holding a bolt on said bolt support surface, wherein said bolt retaining spring extends from said support at a downward and rearward angle toward said bolt support surface and then at an upward and rearward angle to a free end between said bolt support surface and said support.

2. The crossbow set forth in claim 1 wherein said bolt retaining spring has a first portion underlying and secured to said support, a second portion extending downwardly and rearwardly from a forward end of said first portion, and a third portion extending upwardly and rearwardly from said second portion toward but spaced from said support.

3. The crossbow set forth in claim 2 wherein said bolt retaining spring is of one-piece construction.

4. The crossbow set forth in claim 3 wherein said bolt retaining spring is of spring metal construction.

5. The crossbow set forth in claim 3 wherein a juncture of said second and third portions is spaced from said bolt support surface in an absence of a bolt on said bolt support surface.

6. The crossbow set forth in claim 3 wherein said second and third portions are flat.

7. The crossbow set forth in claim 3 wherein said second and third portions are arcuate.

8. The crossbow set forth in claim 7 wherein said second and third portions are joined to each other in a continuous arc.

9. The crossbow set forth in claim 8 wherein said continuous arc is at constant radius of curvature.

10. A crossbow that includes:

a barrel having a bolt support surface, a forward end with at least one flexible limb, and a rearward end, a support on said barrel overlying at least a portion of said bolt support surface, and a bolt retaining spring on said support and extending toward said bolt support surface for holding a bolt on said bolt support surface, wherein said bolt retaining spring is of one-piece spring metal construction, and has a first portion underlying and secured to said support, a second portion extending downwardly and rearwardly from a forward end of said first portion, and a third portion extending upwardly and rearwardly from said second portion toward but spaced from said support, a juncture of said second and third portions being spaced from said bolt support surface.

11. The crossbow set forth in claim 10 wherein said second and third portions are flat.

12. The crossbow set forth in claim 10 wherein said second and third portions are arcuate.

13. The crossbow set forth in claim 12 wherein said second and third portions are joined to each other in a continuous arc.

* * * * *